United States Patent [19]

Antonino

[11] Patent Number: 5,044,012

[45] Date of Patent: Sep. 3, 1991

[54] ASSEMBLY AND METHOD FOR PROTECTING ORNAMENTAL ACCESSORIES ON GARMENTS

[75] Inventor: Tre R. Antonino, Dallas, Tex.

[73] Assignee: Donna Hartley, Dallas, Tex.

[21] Appl. No.: 606,746

[22] Filed: Oct. 31, 1990

[51] Int. Cl.[5] ..... A41D 27/12

[52] U.S. Cl. ..... 2/46; 2/265; 24/DIG. 29; 24/306

[58] Field of Search ..... 2/46, 265, 266; 51/265, 51/274; 24/113 R, 306, 442, DIG. 29

[56] References Cited

U.S. PATENT DOCUMENTS 321,177 6/1885 Beals ..... 2/46
702,278 6/1902 Bascom ..... 51/265
4,648,137 3/1987 Cooper ..... 2/DIG. 6

FOREIGN PATENT DOCUMENTS 88324 5/1922 Austria ..... 51/265

*Primary Examiner*—Werner H. Schroeder
*Assistant Examiner*—Gloria Hale
*Attorney, Agent, or Firm*—Warren B. Kice

[57] ABSTRACT

A padding assembly including a first pad member which is placed between the garment and the accessory to be protected, and a second pad member that extends over the first pad member in engagement therewith, with the accessory being sandwiched between the pad members. After dry cleaning and/or laundering, the pad members can easily be detached and removed from the accessory and the garment.

12 Claims, 1 Drawing Sheet

ASSEMBLY AND METHOD FOR PROTECTING ORNAMENTAL ACCESSORIES ON GARMENTS

BACKGROUND OF THE INVENTION

This invention relates to an assembly for protecting buttons, or other ornamental accessories, on garments and, more specifically, to such an assembly which can be quick releasably attached to the garment during dry cleaning or laundering to protect the button, and then removed thereafter.

One of the main problems facing commercial dry cleaners and launderers, as well as individuals using dry cleaning and laundering equipment, is protecting buttons, or other ornamental accessories, attached to garments during the dry cleaning and/or laundering process. More particularly, in each of these processes, the garments are usually placed with many other similar garments in a large machine and "tumbled". This tumbling causes the garments and the buttons on the garments to be subjected to severe forces from the other garments and from the walls of the machine, often causing damage. Also, dry cleaning and other hazardous chemicals are often used in dry cleaning and laundering which often react with and damage the buttons or accessories.

It can be appreciated that the replacement of damaged buttons, or other ornamental accessories, on the garment is extremely labor intensive and therefore expensive.

SUMMARY OF THE INVENTION

It is therefore an object of the present invention to provide an assembly and method for protecting buttons, or other ornamental accessories, attached to a garment during dry cleaning and laundering of the garment.

It is still a further object of the present invention to provide an assembly and method of the above type in which the assembly can be quickly attached over the button and will remain so during the dry cleaning and laundering process.

It is a still further object of the present invention to provide an assembly and method of the above type in which the assembly is quickly detachable from the button.

Toward the fulfillment of these and other objects the padding assembly of the present invention includes a first pad member which is placed between the garment and the button to be protected, and a second pad member that extends over the first pad member in engagement therewith, with the button being sandwiched between the pad members. After dry cleaning and/or laundering, the pad members can easily be detached and removed from the button and the garment.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
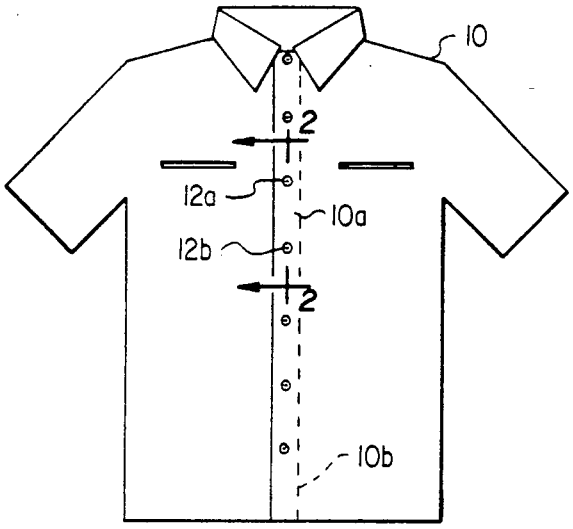
FIG. 1 is a front elevational view of a garment having a plurality of buttons attached thereto.
Figure 2:
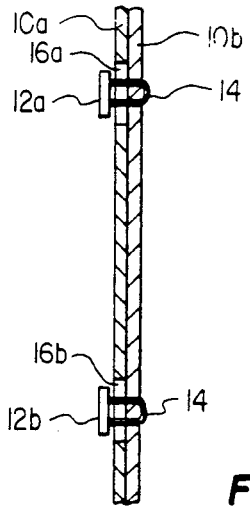
FIGS. 2, 4 and 6 are enlarged, vertical cross-sectional views taken along the lines 2—2 and 4—4 and 6—6, respectively, of FIGS. 1, 3 and 5, respectively.

Referring specifically to FIGS. 1 and 2 of the drawings, the reference numeral 10 refers in general to a garment which can be a blouse, shirt, dress, coat, or the like, having an overlapping marginal portion 10*a* which overlaps a marginal portion 10*b* when the garment is in use. In order to secure the overlapping marginal portion 10*a* to the marginal portion 10*b*, a plurality of buttons, two of which are shown by the reference numerals 12*a* and 12*b*, are attached to the marginal portion 10*b* in any conventional manner including the most common technique of "sewing" the button on the garment by running a small thread 14 (FIG. 2) through the garment and through appropriate openings formed in the button. As shown in FIG. 2, the buttons 12*a* and 12*b* extend through corresponding openings 16*a* and 16*b* formed through the overlapping marginal portion 10*a* to attach the marginal portions 10*a* and 10*b* when the garment is being worn.

Figure 3:
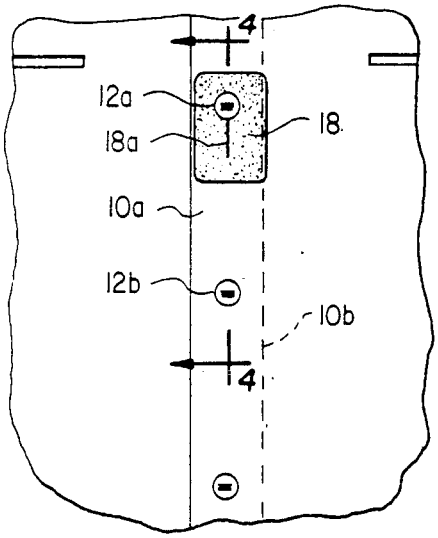
FIG. 3 is an enlarged, partial, front elevational view of a portion of the garment of FIG. 1 with one pad member of the present invention attached to one of the buttons to be protected.
Figure 4:
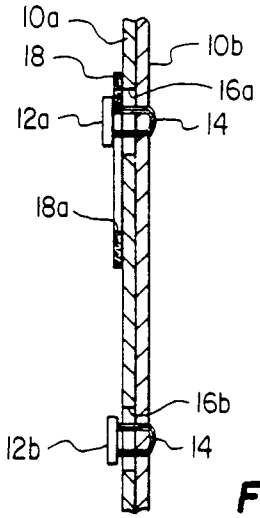

FIGS. 3 and 4 depict the garment 10 of FIG. 1 with a pad member 18, forming a portion of the padding assembly of the present invention, extending between the button 12*a* and the overlapping marginal portion 10*a*. According to a preferred embodiment, a small through opening, or slit 18*a*, is formed in the pad member 18 and the button is threaded through the slit so that the pad member 18 extends between the button 12*a* and the garment 10. The slit 18*a* is equidistant between the respective two sets of opposed marginal edges of the pad member 18, and preferably the pad 18 is pushed down over the thread 14 until the thread is positioned in the upper end of the slit 18*a* as better shown in FIG. 4.

Figure 5:
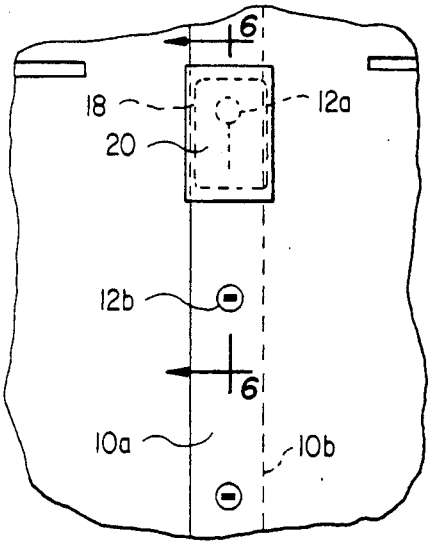
FIG. 5 is a view similar to FIG. 3 but depicting the second pad member of the present invention extending over the first pad member with the button sandwiched therebetween.
Figure 6:
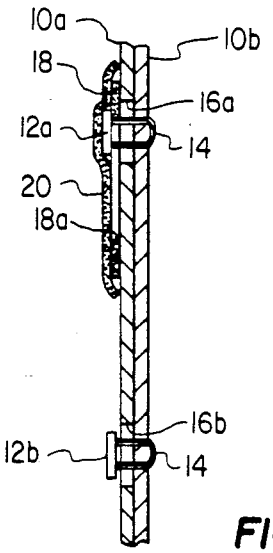

Referring to FIGS. 5 and 6, the reference numeral 20 refers to the second pad member of the padding assembly of the present invention which has been placed over the first pad member 18 with the button 12*a* sandwiched therebetween. As shown, the length and width of the pad member 20 is greater than the diameter of the button and the length and width of the pad member 18 so that the former completely overlaps the latter. As better shown in FIG. 6, the pad member 20 "bends" around the button 12*a* and the inner surfaces of its marginal edge portions are in engagement with the corresponding outer surfaces of the pad member 18.

The preferred technique of attaching the inner surface of the pad member 20 to the outer surface of the pad member 18 is by a well known "hook and loop fastener" such as the type manufactured by Velcro Fastening Systems in Manchester, N.H. According to this technique, the pad member 18 consists of a backing tape, or the like, having a multitude of relatively small hooks extending therefrom; while the pad member 20 consists of a tape or backing member having a multitude of loops extending therefrom. Thus the pad member 18 is placed on the garment 10 with its hooks facing outwardly, or away from the garment, and the pad member 20 is positioned with its loops facing the hooks of the pad member 18. As a result, the loops of the pad member 20 would be engaged by the hooks of the pad member 18 when the pad members are brought into engagement, to quick detachably attach the pad members. Since the hook and loop fastener is well know, it will not be described in any further detail.

In operation, the button 12*a* is forced through the slit 18*a* provided in the pad member 18 with the latter member being oriented so that its hooks face outwardly or in a direction away from the garment. The pad member 18 would thus extend substantially between the garment 10 and the button 12*a*. Preferably the pad member 18 is then lowered relative to the button 12*a* so that the threads 14 extends in the upper end portion of the slit 18*a*. The pad member 20 is then advanced towards the pad member 18 with the loops of the member 20 facing the hooks of the member 18 until the outer marginal edge portions of the members 18 and 20 attach with the button 12*a* sandwiched therebetween.

After the garment 10 has been subjected to the dry cleaning or laundering process, the pad member 20 can easily be detached from the pad member 18 by simply pulling it away to detach the loops from the hooks. Then the pad member 18 can be disengaged from the button 12*a* to complete the removal of the padding assembly from the button and the garment. Of course, a separate pad assembly, each consisting of pad members 18 and 20, would be used for each button on the garment.

It is thus seen that the assembly and method of the present invention enjoys several advantages. For example, relatively expensive buttons can be easily protected with a minimum of labor and cost. Also, the feature of sizing the outer pad member 20 greater than that of the inner pad member 18 protects the material of the garment from catching on the hooks of the pad member 18.

It is understood that several variations may be made in the foregoing. For example, the assembly of the present invention is not limited to protecting buttons on the garment but can protect any type of ornamental accessory that would normally be attached to a garment. Also, the present invention is not limited to the specific arrangement of the hooks and loops as described above, since the inner pad member 18 could be provided with loops and the outer pad member 20 with hooks within the scope of the invention. Further, the respective pad members 18 and 20 could take several shapes other than those specified above. Further, the button, after being passed through the slit 18*a* of the pad member 18, could be centered between the ends of the slit or located near the lower end of the slit. Also, it is understood that the present invention is not limited to a pad assembly which only accommodates one button 12*a*. For example, an elongated assembly could be provided so that the inner pad (comparable to pad member 18) would have a length and a slit greater in length than the distance spanned by two or more buttons so that it could receive the buttons. Of course, the outer pad member (comparable to pad member 20) would be sized accordingly. Still further, the two pad members could be preattached by the hook and loop fastener or by other means, such as glue, welding, stitching, or the like, before they are placed over the button or buttons on the garment. In this case a slit could be provided in the inner pad member and the button inserted through the slit as described above.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A padding assembly for protecting an ornamental accessory, such as a button, attached to a garment, said assembly comprising a first pad member extendable between the garment and the button, a second pad member engageable with at least a portion of said first pad member with said button sandwiched between said members, and means for attaching said pad members together.

2. The assembly of claim 1 further comprising a slit formed through said first pad member, said accessory being passed through said slit so that said first pad member extends between said accessory and said garment.

3. The padding assembly of claim 1 wherein the sizes of said pad members are greater than that of the accessory so that the respective marginal end portions of the padding members engage with the accessory extending between the pad members.

4. The assembly of claim 1 wherein the first pad member has a thickness less than the space between said accessory and said garment and a length and width greater than the corresponding dimensions of said accessory.

5. The assembly of claim 4 wherein said second pad member has a length and width greater than that of said first pad member to completely cover said first pad member.

6. The assembly of claim 1 wherein said attaching means comprises means for quick releasably attaching said pad members.

7. The assembly of claim 6 wherein said attaching means is a hook and loop fastener.

8. The padding assembly of claim 7 wherein the hooks of said hook and loop fastener are on one of said pad members and the loops of said hook and loop fastener are on the other pad member.

9. The assembly of claim 8 wherein said first pad member comprises a backing tape and a plurality of said hooks extending therefrom, and wherein said second pad member comprises a backing tape and a plurality of said loops extending therefrom which are adapted to be engaged by said hooks.

10. A method of protecting an ornamental accessory such as a button, attached to a garment, said method comprising the steps of placing a first pad member between the accessory and the garment, placing a second pad member over said first pad member with said accessory sandwiched therebetween, and attaching said members together.

11. The method of claim 10 wherein said step of attaching comprises the step of quick-releasably attaching said pad members together.

12. The method of claim 10 wherein said step of placing comprises the step of forming a slit through said first pad member and passing said accessory through said slit.

* * * * *